US008624414B2

(12) United States Patent
Bennauer et al.

(10) Patent No.: US 8,624,414 B2
(45) Date of Patent: Jan. 7, 2014

(54) METHOD AND DEVICE FOR CONTROLLING A STEAM POWER PLANT

(75) Inventors: Martin Bennauer, Bottrop (DE); Heribert Werthes, Essen (DE)

(73) Assignee: Siemens Aktiengesellschaft, München (DE)

( * ) Notice: Subject to any disclaimer, the term of this patent is extended or adjusted under 35 U.S.C. 154(b) by 505 days.

(21) Appl. No.: 13/060,308

(22) PCT Filed: Aug. 17, 2009

(86) PCT No.: PCT/EP2009/060593
§ 371 (c)(1),
(2), (4) Date: Feb. 23, 2011

(87) PCT Pub. No.: WO2010/026035
PCT Pub. Date: Mar. 11, 2010

(65) Prior Publication Data

US 2011/0156408 A1 Jun. 30, 2011

(30) Foreign Application Priority Data

Aug. 25, 2008 (EP) ..... 08015000

(51) Int. Cl.
*F02C 9/00* (2006.01)

(52) U.S. Cl.
USPC ..... 290/52; 60/39.27

(58) Field of Classification Search
USPC ..... 290/40 R, 40 C, 52; 60/726, 39.27
See application file for complete search history.

(56) References Cited

U.S. PATENT DOCUMENTS

| | | | | |
|---|---|---|---|---|
| 5,301,499 | A | 4/1994 | Kure-Jensen et al. | |
| 5,949,146 | A * | 9/1999 | VandenBerghe | 290/40 R |
| 6,141,952 | A * | 11/2000 | Bachmann et al. | 60/772 |
| 6,164,057 | A * | 12/2000 | Rowen et al. | 60/39.27 |
| 6,838,781 | B2 * | 1/2005 | van de Loo | 290/40 B |
| 6,880,324 | B2 * | 4/2005 | Tanaka | 60/39.182 |
| 7,188,475 | B2 * | 3/2007 | McGinley et al. | 60/726 |
| 8,093,734 | B2 * | 1/2012 | Yuri | 290/40 C |

FOREIGN PATENT DOCUMENTS

| | | | |
|---|---|---|---|
| DE | 4411327 | C1 | 3/1995 |
| DE | 19545520 | A1 | 6/1996 |
| EP | 0465137 | A1 | 1/1992 |
| JP | 61023365 | A | 1/1986 |
| JP | 4232311 | A | 8/1992 |

(Continued)

OTHER PUBLICATIONS

Ackenheil R et al, "Primary Frequency Control for Combined Cycle Power Plants", VGB Powertech, Essen, DE, Bd. 86, No. 3, Jan. 1, 2006, pp. 76-78; XP001241930; ISSN: 1435-3199; Others; 2006; DE.

*Primary Examiner* — Nicholas Ponomarenko

(57) ABSTRACT

A method for controlling a steam power plant is provided. The method includes the steps of providing a first signal showing a reduction of the current power level of the generator, generating a second signal showing a short circuit interruption as a function of the first signal, resetting the second signal after a predetermined time period and blocking the second signal for a predetermined period of time, stopping and subsequently starting the turbine as a function of the second signal, generating a third signal showing a load rejection as a function of the first signal, and permanently stopping the turbine as a function of the third signal. A device for controlling a steam power plant is also provided.

20 Claims, 5 Drawing Sheets

(56) References Cited

FOREIGN PATENT DOCUMENTS

| | | | |
|---|---|---|---|
| JP | 5009602 | A | 1/1993 |
| JP | 2540202 | B2 | 10/1996 |
| JP | 11081915 | A | 3/1999 |
| RU | 2166644 | C2 | 5/2001 |
| RU | 2169272 | C2 | 6/2001 |
| WO | WO 2008099894 | A1 | 8/2008 |

* cited by examiner

METHOD AND DEVICE FOR CONTROLLING A STEAM POWER PLANT

CROSS REFERENCE TO RELATED APPLICATIONS

This application is the US National Stage of International Application No. PCT/EP2009/060593, filed Aug. 17, 2009 and claims the benefit thereof. The International Application claims the benefits of German application No. 08015000.6 EP filed Aug. 25, 2008. All of the applications are incorporated by reference herein in their entirety.

FIELD OF INVENTION

The invention relates to a method for controlling a steam power plant having a generator and a turbine.

BACKGROUND OF INVENTION

Steam power plants contribute decisively to the stabilization of voltage and frequency both in interlinked networks and in island networks. In order to meet these stabilization requirements, the control strategies of steam power plants must fulfill the highest possible demands. The control strategies, in this context, are especially important in the event of network accidents and rapid load changes.

If, for example, the rotation of the generator deviates sharply from the nominal value and the machine runs the risk of slips or the shafting of the generator and turbine is put at risk by rotational overspeed, the entire steam power plant has to be decoupled in a directed manner from the associated network and run down to its own requirements so that it is available again as quickly as possible for the network configuration. After such load shedding, the power at the terminals of the generator is reduced in a short time to low values. So that the shafting is not accelerated excessively due to such a diminution in the actual power of the generator, valves of the associated turbine have to be shut quickly. After load shedding, the electrical power of the terminals of the generator generally remains at a low value for a lengthy period of time.

By contrast, the accident referred to below as a short circuit interruption is a usually 3-pole network short circuit in the vicinity of the power plant which lasts for only a few 100 ms. In the event of such a network accident, the power at the terminals of the generator is briefly equal to zero on account of the voltage collapse mentioned. Insofar as the short circuit can be extinguished within a fault clear-up time of at least 150 ms, the generator will continue to feed active power and reactive power into the network in order to stabilize frequency and voltage. Hence, if the short circuit is present for 150 ms or a shorter time, the shafting should not slip nor should the associated turbine be run down. In many steam power plants, the possible fault clear-up time is even markedly shorter.

The control of a steam power plant must react to both accidents, the problem being that the power shedding and the short circuit interruption cannot be distinguished at the commencement of each of these, since, in both cases, the power at the terminals of the generator falls. Furthermore, there is the problem that, although, in the case of short circuit interruption, the electrical power returns after the fault clear-up, whereupon the turbine would have to continue to be operated, nevertheless, as time goes on, the electrical power often swings through its zero passage, and therefore, if predefined power limit values are undershot, movement controllers detect an accident once again. With each accident detection, particularly in known steam power plants, the power of the associated turbine is reduced in that associated valves are shut quickly. On account of said swing of the generator active power about the zero point after a short circuit interruption, such rapid valve motion of the steam turbine may experience a frequent successive response. As a result, the turbine power and therefore the feed of active power into the network are greatly reduced for a disproportionately long time of several seconds.

If this problem arises in several steam power plants, it leads to unacceptable load flow and frequency problems. In the event of faults of this kind, the steam power plants must ensure the frequency and voltage stability of the network within a time range of a few 100 ms.

SUMMARY OF INVENTION

The object on which the invention is based is to provide a method for controlling a steam power plant having a generator and a turbine, in which the abovementioned problems are as far as possible avoided and, in particular, voltage and frequency stability in the associated network is ensured both during load shedding and during a short circuit interruption.

The object is achieved, according to the invention, by means of a method for controlling a steam power plant having a generator and a turbine, as claimed in the claims. Furthermore, the object is achieved by means of a device for controlling a steam power plant, as claimed in the claims. Advantageous developments of the invention are described in the dependent claims.

The method according to the invention for regulating a steam power plant having a generator and a turbine comprises the steps: provision of a first signal which indicates a diminution in the actual power of the generator, generation of a second signal which indicates a short circuit interruption, as a function of the first signal, resetting of the second signal after a predetermined first time span and blocking of the second signal for a predetermined second time span, stopping and subsequent starting of the turbine as a function of the second signal, generation of a third signal which indicates load shedding, as a function of the first signal, and permanent stopping of the turbine as a function of the third signal.

The solution according to the invention is based on the recognition that, in the event of a short circuit interruption, although the frequent response and asymmetric floating time of the valves of the associated turbine when rapid motion is triggered in the opening and the closing direction are to be avoided as far as possible because the power of the turbine is thereby gradually run down, nevertheless, even in the event of a short circuit interruption, a once-only switching of rapid motion should not be prevented because such rapid motion leads to a cutback of the turbine torque, this having a damping action upon the network swing which otherwise arises.

On the basis of this, the solution according to the invention follows a path whereby, in both accidents mentioned (that is to say, both during a short circuit interruption and during load shedding), a signal is generated which first leads to the stopping of the turbine. In the wording of the independent claim, this signal is the second signal which is generated as a function of or simultaneously with a first signal which indicates a diminution in the actual power of the generator. In other words, the turbine of the steam power plant according to the invention is therefore stopped or reduced in power (which, as a rule, takes place by means of rapid valve motion), as soon as an associated signal indicates an appreciable diminution in the actual power of the generator. Furthermore, in the method according to the invention, after this stopping of the turbine, the latter is started again. During this stopping and starting, a check is made by the control according to the invention of the associated steam power plant, to ascertain whether further criteria for load shedding are present. Insofar as load shedding is detected and an associated third signal is generated, only then is a permanent stopping of the turbine triggered as a function of this signal which is the third signal in the wording of the independent claim. In other words, in the method according to the invention, both during the short circuit interruption and during load shedding the turbine is first basically stopped, and only as time goes on is a check carried out as to whether a distinction can be made between a short circuit interruption and load shedding. During this period of time, the turbine is put into the starting mode again as a precaution, so that it is fully started as soon as the short circuit interruption has been detected and the load shedding situation has in fact not been detected.

Furthermore, it is important in the method according to the invention that the second signal which indicates a short circuit interruption is reset and subsequently blocked. This ensures that this second signal cannot indicate a short circuit interruption once again when the generator active power swings about the zero point in the following period of time.

In other words, by means of the method according to the invention, a distinction can be made between load shedding and a short circuit interruption in that a second signal, as it is referred to, always triggers a brief cutback of the associated turbine, that is to say the desired power of the generator is briefly set at zero. Only a third signal triggers a permanent cutback of the associated turbine, the desired power of the generator then being set permanently at zero. This third signal is generated independently of the second signal and forms the distinguishing signal in order to distinguish the initially assumed short circuit interruption from load shedding.

In a first advantageous development of the method according to the invention, the first signal is provided when the actual power of the generator has diminished abruptly by the amount of a predetermined value or the actual power of the generator is higher than a predetermined negative value and the actual power of the generator has become lower than double its own requirements and also the reference between a desired power and the actual power of the generator has become higher than double its own requirements. In other words, the first signal, which indicates a diminution in the actual power of the generator, is generated when the generator power diminishes in the form of jumps, this jumping diminution preferably amounting to at least 70%. To check for power jumps, the power signal is first preferably filtered by means of a DT1 element. The following link is coupled in the form of an OR operation to this condition: the generator power is compared with a predetermined negative value, in particular −2%. If the generator power is higher than this value, the generator is not operating in the motor mode, the powers of which are higher than this nominal power. A check is made, furthermore, as to whether the actual power of the generator has become lower than double its own requirements. As a third condition, a check is made as to whether the difference between the power desired value and power actual value is higher or lower than double its own requirements. A lowering of the actual power can thus be detected. The three conditions mentioned above are in this case linked to a logical AND. The signal is therefore generated when all these conditions are fulfilled or the generator power has changed abruptly by the amount of said predetermined value.

In a second advantageous development of the method according to the invention, the predetermined first time span amounts to between 100 ms and 200 ms, in particular to 150 ms. The predetermined first time span serves for fixing how long the second signal remains set and therefore a short circuit interruption is indicated. This second predetermined time span is advantageously dimensioned such that the associated turbine can be stopped or its valves can be closed quickly, that is to say rapid motion can be triggered. At the same time, this predetermined first time span is selected such that the turbine is put into the starting mode again quickly in order to assist frequency and voltage stability in the network by feeding active and reactive power by means of the generator. Starting itself entails a certain delay, the result of which is that the turbine can be permanently stopped sufficiently quickly within the framework of the following load shedding check.

In a third advantageous development of the method according to the invention, the predetermined second time span amounts to between 4 s and 10 s, in particular to 7 s. The predetermined second time span serves for blocking the second signal and for preventing the situation where, after a short circuit interruption is detected by a swing of the generator active power above the zero point, short circuit interruption detection experiences a frequent successive response. The predetermined second time span is in this case advantageously selected in such a way that the mechanical torque and consequently the electrical power of the generator return again more quickly than this selected second time span.

In a fourth advantageous development of the method according to the invention, the generation of the third signal which indicates load shedding takes place as a function of the first signal and of a predetermined third time span. Thus, once again, the first signal is the trigger for the signal indicating load shedding, and it is additionally ascertained whether this first signal is present permanently during a predetermined third time span. Load shedding is therefore present when the actual power of the generator is greatly diminished for a longer period of time, in fact this predetermined third time span. In the event of a short circuit interruption, by contrast, a power close to zero is generally present for only a few 100 ms.

Especially preferably, the predetermined third time span is selected to have a value of between 1.5 s and 2.5 s, in particular of 2 s. The result of this time span is that it can be ascertained reliably whether load shedding is present or, for example, there is only a swing of electrical power about the mechanical power after a short circuit interruption. Furthermore, the time span is selected in such a way that the associated turbine is permanently stopped sufficiently early. In this case, in particular, care must be taken to ensure that, after a renewed starting of the turbine after the setting of the short circuit interruption signal, this starting is controlled by means of an associated regulation of the rotational speed of the turbine. With the lapse of the electrical power of the generator, the drive train of the turbine is accelerated sharply in such a way that the rotational speed control of the latter intervenes sufficiently and overspeeding of the turbine is prevented. The result of this also is that the turbine, which commences actual starting again after approximately 1.5 s after stopping, does not overspeed in the event of permanent stopping after 2 s, and, at most, a very brief slip of the generator takes place. After load shedding, therefore, the shafting accelerates and takes up the excess power of the turbine which it can no longer discharge to the network. The rotational speed of the turbine rises above the nominal value (for example, to a value up to 5% above nominal value). Thereupon, the rotational speed controller critically determines the manipulated variable for opening the associated valves of the turbine. The valves consequently remain shut, even when the signal for starting the turbine as a function of the second signal is already present again. Subsequently, where appropriate, the signal for the permanent stopping of the turbine occurs so that the valves still remain closed, overall, during this period of time and the turbine torque is run at zero, as required, until the rotational speed of the turbine lies below the desired value.

In a sixth advantageous development of the method according to the invention, the generation of the third signal which indicates load shedding takes place as a function of a load switch for the generator. The load switch of the generator indicates whether the generator should feed any electrical power at all into the network. However, such a load switch is not reliably co-actuated in the event of any load shedding, and therefore, for this reason, the abovementioned conditions are additionally taken into account in order to detect load shedding reliably.

BRIEF DESCRIPTION OF THE DRAWINGS

An exemplary embodiment of the solution according to the invention is explained in more detail below by means of the accompanying diagrammatic drawings in which.

DETAILED DESCRIPTION OF INVENTION

Figure 1:
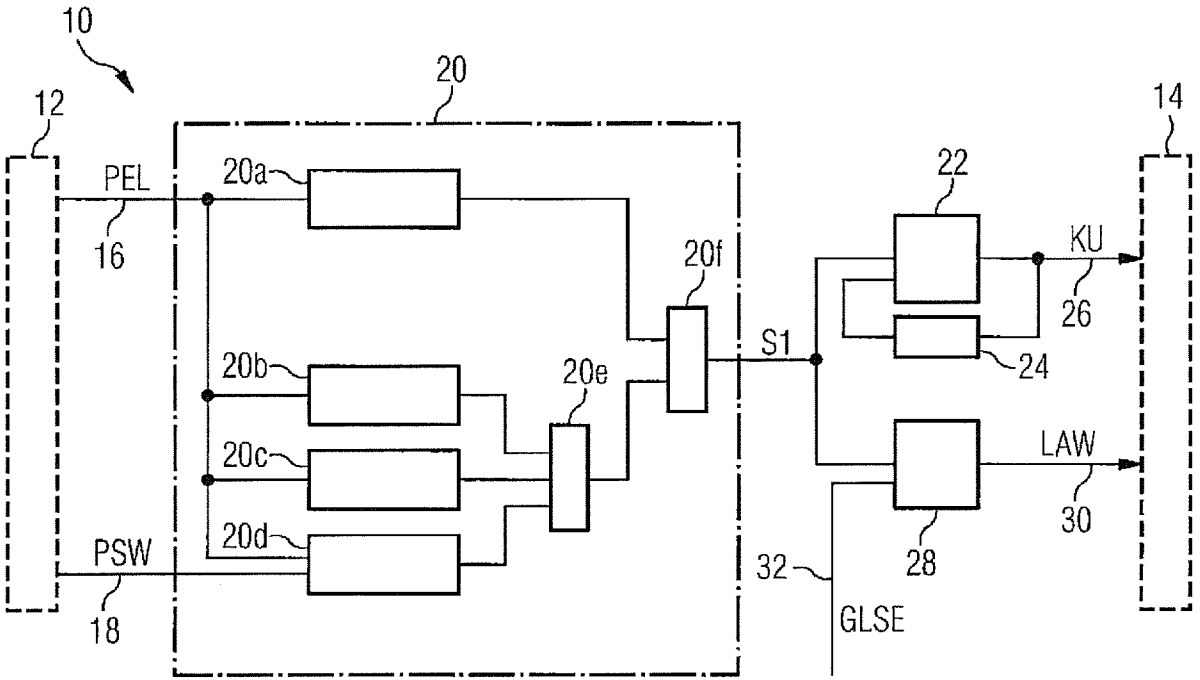
FIG. 1 shows a diagram of a device according to the invention for controlling a steam power plant.

FIG. 1 illustrates a circuit arrangement or a device 10 for controlling a steam power plant, not illustrated in any more detail, having a generator 12 and a turbine 14. The device 10 comprises as essential elements a PEL signal line 16 and a PSW signal line 18 which lead from the generator 12 to a means 20 for providing a first signal. This means 20 is configured as a control or regulating arrangement in which, overall, six switching elements 20*a*, 20*b*, 20*c*, 20*d*, 20*e* and 20*f* are formed. In this case, the actual power (PEL) of the generator 12 is transferred via the PEL signal line 16 to the switching element 20*a* which checks whether the actual power has fallen abruptly by the amount of a predetermined value GPLSP. Thus, in the present case, in particular, a jumping diminution of greater than 70% is checked. For checking for such power jumps, the power signal PEL is first filtered by means of a DT1 element.

In the switching element 20*b*, it is derived from the input signal PEL whether the actual power of the generator 12 is higher than a specific negative value GPNEG. In the present case, in particular, the generator power is compared with the value GPNEG=−2%. It is thereby checked whether the generator 12 is operating in motor mode with powers higher than −2% of the nominal power.

In the switching element 20*c*, a check is made as to whether the actual power PEL of the generator 12 is lower than double its own requirements GP2EB.

A fall of the actual power to less than double its own requirements is thus detected.

By means of the switching element 20*d*, the difference between the power desired value and the power actual value is determined by means of the input signals actual power PEL and desired power PSW of the generator 12 and is compared with the value 2× own requirements. A fall of the actual power is thus detected.

The results of the switching elements 20*b*, 20*c* and 20*d* are linked to one another via the switching element 20*e*, the latter forming an AND link. The result of this linkage is linked by means of the switching element 20*f* to the result of the switching element 20*a*, these linkages in the switching element 20*f* being an OR link. Thus, by the means 20 for providing a first signal, a signal S1 is generated which indicates whether there is a diminution of the actual power PEL of the generator 12. This signal S1 is supplied to a means 22 for generating a second signal KU. This signal KU is considered as a signal which basically indicates a short circuit interruption, specifically as a function of the first signal S1. After a predetermined first time span TKU of 150 ins in the present case, the second signal KU generated is reset and is subsequently blocked for a predetermined second time span CSPKU of 7 s in the present case. This takes place by a means 24 for resetting and blocking the second signal KU, this means being configured with an RS flipflop and with an associated set signal. The signal is held for the time span of CSPKU and is sent to the reset input of the flipflop. This connection has the effect that the KU signal is present for a maximum of 150 ms and thereafter can be present again only after 7 s at the earliest. The KU signal is transferred via a KU signal line 26 to the turbine 14 where a means, not illustrated, in the form of a controller is provided for stopping and starting the turbine 14. This controller causes a temporary cutoff of the power desired value PSW of the turbine 14 on the basis of the brief KU signal.

Furthermore, the signal S1 is conducted to a means 28 for generating a third signal LAW, this third signal LAW being formed when the first signal S1 is present for longer than a predetermined third time span TLAW, 2 s in the present case. The signal LAW is in this case conducted via a LAW signal line 30 to the turbine 14 where a means, not illustrated, for the permanent stopping of the turbine as a function of the LAW signal 30 is provided.

Figure 2:
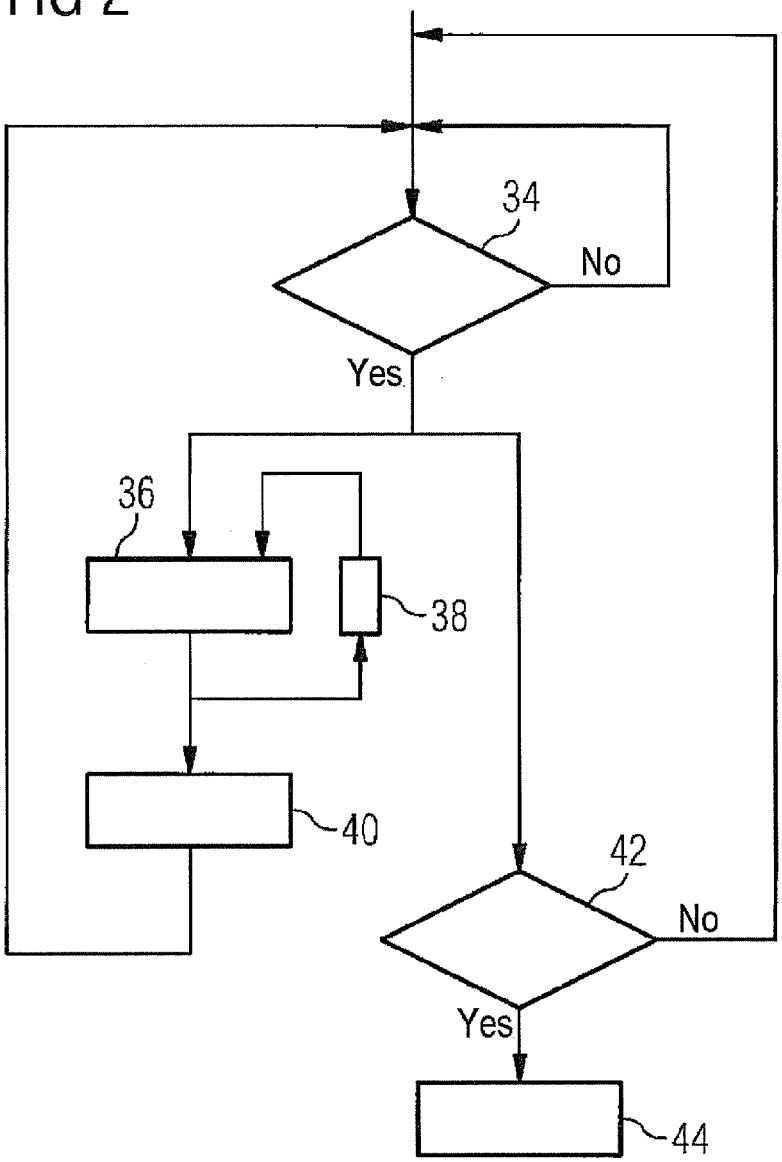
FIG. 2 shows a diagram of a method according to the invention for controlling a steam power plant.

FIG. 2 illustrates the associated method flow for controlling a steam power plant having the generator 12, the turbine 14 and the device 10. The method comprises a step 34 in which the first signal S1 is provided which indicates a diminution in the actual power PEL of the generator 12. This signal is either NO or 0, in which case there is a return to the input of step 34, or the signal S1 is 1 or YES, in which case a further step 36 for generating the second signal KU first takes place. As explained above, the signal KU indicates basically a short circuit interruption or it is assumed that such a short circuit interruption could occur. In the following step 38, the second signal KU is then reset after a predetermined first time span TKU and subsequently the predetermined second time span TSPKU is blocked. In this case, a loop is run through which leads back to step 36. At the same time, the signal generated in this way and then reset and blocked is supplied to a step 40 in which the turbine 14 stops and is subsequently started again. The path from step 40 subsequently leads back to step 34.

Furthermore, in a step 42, simultaneously with steps 36, 38 and 40, a check is made by means of the positive signal S1 as to whether the signal S1 is permanently present for only the third time span TLAW of 2 s in the present case. In cases not so, the method returns to the step 34. But if this is so, the associated third signal LAW is set to YES or 1 and, in a step 44, the turbine 14 is stopped permanently.

Figure 3:
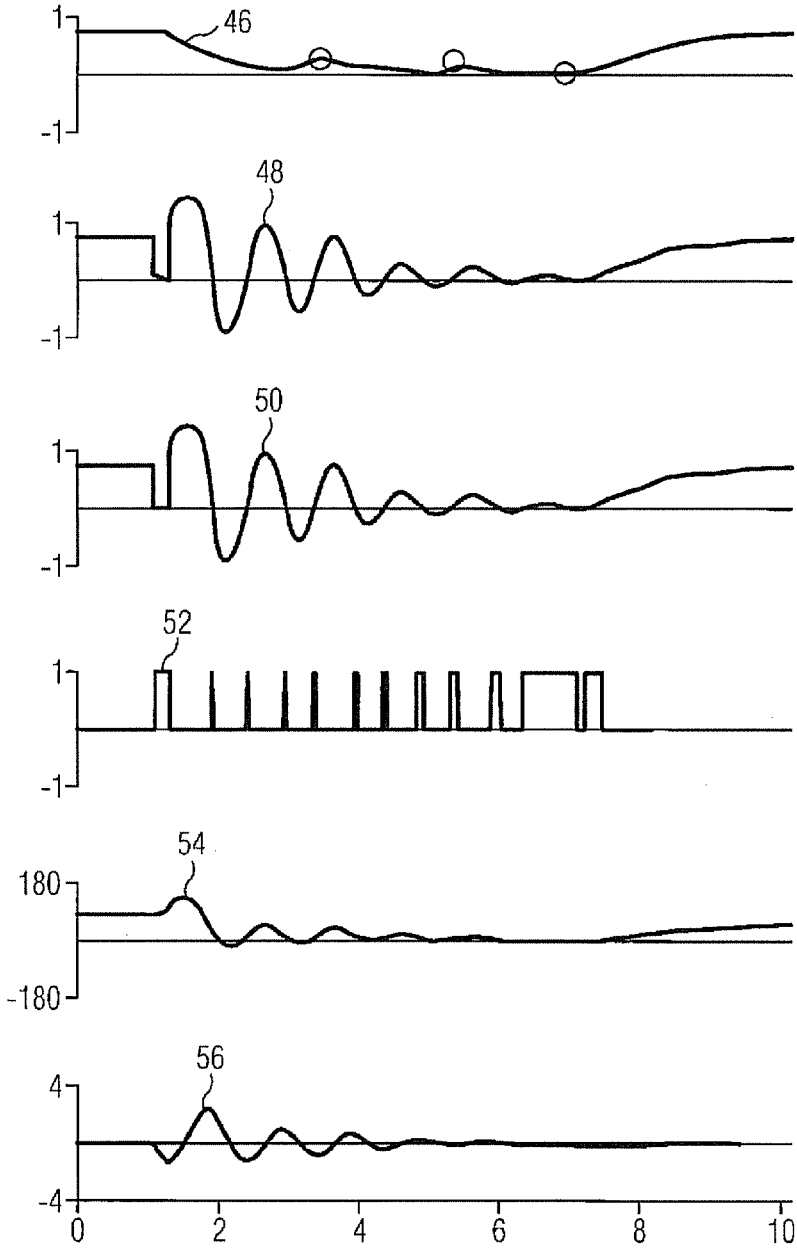
FIG. 3 shows the profiles of various characteristic quantities of a steam power plant in the event of a short circuit interruption according to the prior art.

In FIG. 3, various profiles of signals and measurement values of the generator 12 and of the turbine 14 are plotted against time. In this case, a method for controlling a steam power plant according to the prior art is illustrated, a first curve 46 showing the profile of the mechanical torque of the turbine 14. It can be seen how this mechanical torque falls on account of a sudden diminution in the actual power of the generator and subsequently rises at least slightly again because of the presence of a short circuit interruption. The curves 48 and 50 show the associated profile of the electrical torque of the generator 12 and of the active power of the generator 12. This active power corresponds to the actual power PEL. It can be seen that both the electrical torque and the active power begin to oscillate on account of the short circuit interruption and have a frequent zero passage. The curve 52 shows the associated profile or curve of the first signal S1 consequently arising according to the prior art. This signal is generated as a result of the short circuit interruption itself and thereafter, frequently, because of the run through of the zero passage. The result of this is that, on account of the signal S1, the associated turbine 14 is stopped frequently (see the three circle markings on the curve 46) and a sharp reduction and deceleration of the power of the turbine thereby occur. Finally, associated curves 54 and 56 also show the rotor displacement angle in ° and a slip of the generator 12.

Figure 4:
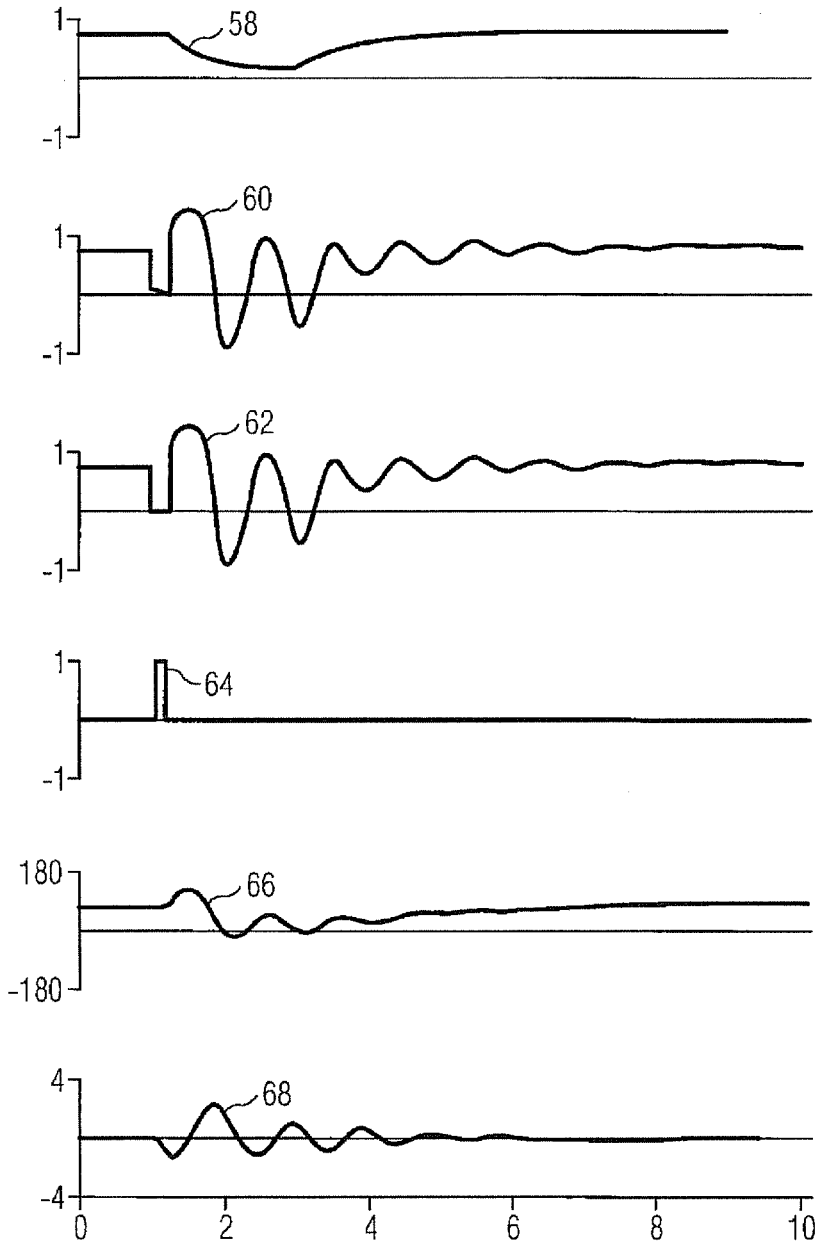
FIG. 4 shows the profiles of various characteristic quantities of a steam power plant in the event of a short circuit interruption in the solution according to the invention.
Figure 5:
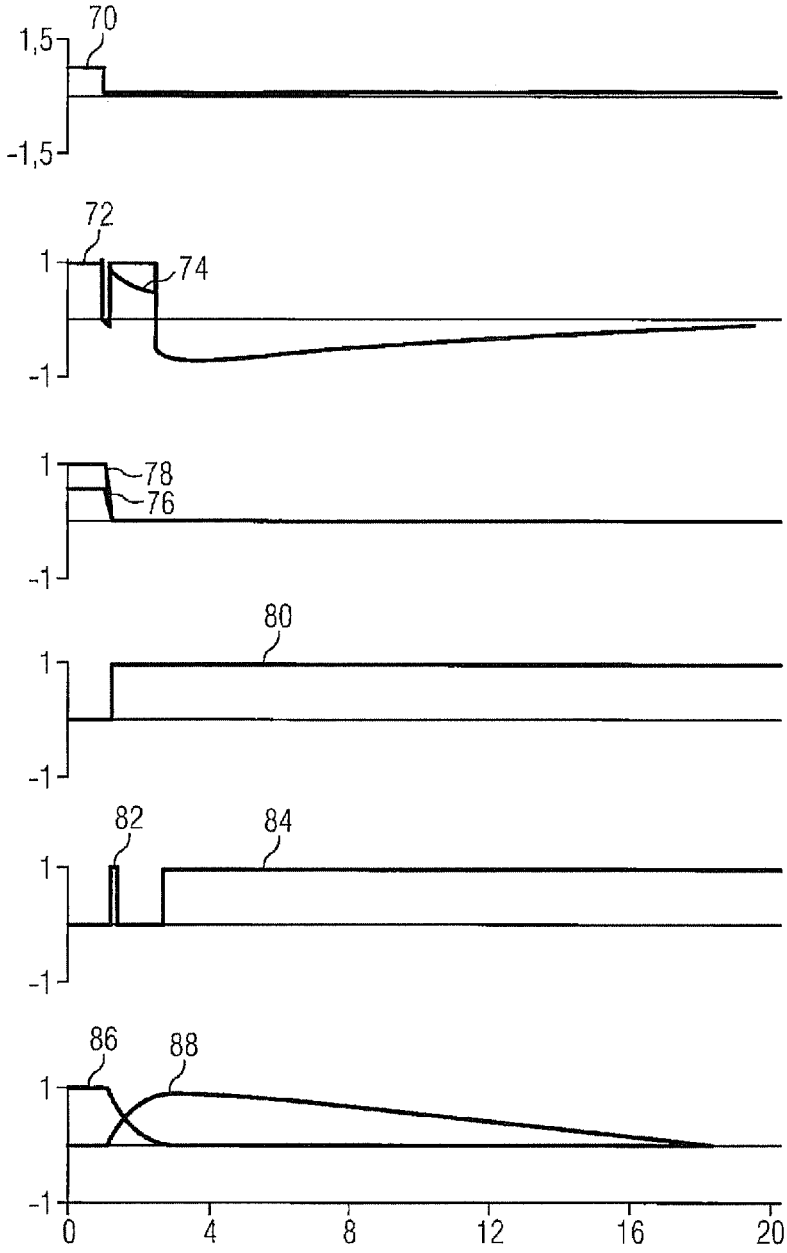
FIG. 5 shows the profiles of various characteristic quantities of a steam power plant in the event of load shedding in the solution according to the invention.

FIGS. 4 and 5 illustrate how the profile of such and similar curves varies when the solution according to the invention comes into effect. In particular, FIG. 4 illustrates by the curve 58 how the mechanical torque behaves over time when a short circuit interruption is ascertained by means of the method according to the invention and the associated device. It can be seen clearly that there is no frequent stopping or triggering of rapid motion.

While curves 60 and 62 show the associated electrical torque and the associated active power of the generator 12, curve 64 illustrates that, in the procedure according to the invention, a comparatively short KU signal is generated once only. As explained above, this is reset and subsequently blocked in such a way that a renewed triggering of rapid motion cannot occur. Accordingly, this procedure leads to a very closely contemporaneous restarting of the associated turbine 14 with a correspondingly different rotor displacement angle (see curve 66) and with a somewhat different slip behavior (see curve 68).

FIG. 5 illustrates how the steam power plant according to the invention behaves when load shedding occurs. A curve 70 in this case shows the active power of the generator and a curve 72 of the associated desired power (PSW). A curve 74 shows the behavior of an associated turbine controller, and it can be seen that this turbine controller, after a short interruption, restarts the associated turbine 14, but limits its rotational speed. Curves 76 and 78 illustrate the associated profile of the medium pressure of the valve for the turbine 14 and of the fresh steam pressure of the valve for the turbine 14. It can be seen here that, with the lapse of mechanical torque, the valves are closed by means of the turbine controller and are subsequently also kept closed in a directed manner for 1.5 s by the turbine controller. A curve 80 shows the associated abovementioned first signal and its profile. It can be seen that this signal is constant from the lapse of the mechanical torque. Finally, a curve 82 shows the profile of the associated abovementioned second signal (KU) which is generated briefly, then reset and subsequently blocked. A curve 84 shows the profile of an abovementioned third signal (LAW) which is generated in such a way that the first signal (see curve 80) is present continuously. By means of this third signal 84, the turbine 14 is correspondingly stopped permanently, and this can be seen again from the profile of curve 74 (turbine controller). A curve 86 shows the profile of the mechanical torque on the turbine, and it can be seen how this mechanical torque falls on account of the lapse of the mechanical torque of the generator 12. With the fall of the mechanical torque, the turbine 14 is at the same time accelerated, since there is a considerable amount of flywheel mass, even though the associated valves are kept closed (see curves 76 and 78). With this acceleration of the turbine 14, a curve 88 is formed which represents the profile of the deviation in rotational speed. It can be seen at the same time that this acceleration takes place to a limited extent such that overspeeding of the turbine 14 cannot occur.

According to the invention, therefore, the rapid motion of the valves in the turbine 14 is triggered by the signal KU and this triggering takes place only once for the reasons mentioned. If, after a predefined time, the signal which has caused the generation of the signal KU continuously to be present, the signal LAW is generated and the valves remain closed until the rotation speed of the turbine has fallen as far as possible, and the mechanical torque can thereafter be increased safely to its own requirements. This delay phase protects the generator 12 against rotational overspeed and generally lasts for longer than 10 s.

It can be concluded from FIGS. 4 and 5 that a frequent triggering of rapid motion in the event of a straightforward short circuit interruption cannot, according to the invention, take place. When the short circuit occurs, the turbine torque is run down and rises again after 1.5 s. The electrical torque (curve 60), the slip (curve 68) and the rotor displacement angle (curve 66) of the generator 12 show the known behavior of a steam power plant in the event of a 3-pole network short circuit. The rotor displacement angle (curve 66) swings about the zero value, which means that the generator 12 has not yet begun to slip. In the event of load shedding to its own requirements, an ordered rundown of the turbine 14 is not impaired because the actual frequent triggering of the KU signal is locked out or blocked according to the invention. Instead, first, the signal KU triggers rapid motion even in the event of load shedding.

Thereafter, admittedly, the turbine 14 is actually started again, with the result that its shafting is accelerated and takes up the excess power of the turbine 14, since the turbine 14 can no longer discharge power to the network via the generator. The rotational speed of the shafting rises by up to 5% above the nominal value (see curve 88). In this case, the rotational speed controller (see curve 74) critically determines the manipulated variable for opening the valves of the turbine 14. As a result, the valves remain shut and the turbine torque is run to zero, as required, until the rotational speed lies below the desired value. After a time span TLAW has elapsed, the signal LAW is set and remains for 5 s in the present case. The result of this is that the turbine is stopped permanently for this period of time.

The invention claimed is:

1. A method for controlling a steam power plant having a generator and a turbine, comprising:

providing a first signal indicating a drop in an actual power of the generator;

generating a second signal which indicates a short circuit interruption, as a first function of the first signal;

resetting of the second signal after a predetermined first time span and blocking of the second signal for a predetermined second time span;

stopping and subsequent starting of the turbine as a second function of the second signal;

generating a third signal which indicates load shedding, as a third function of the first signal; and permanent stopping of the turbine as a fourth function of the third signal.

2. The method as claimed in claim 1, wherein the first signal is provided when the actual power of the generator has dropped abruptly by an amount of a predetermined value, or the first signal is provided when the actual power of the generator has fallen to a predetermined negative value and the actual power of the generator has become lower than double the requirements of the generator and a difference between a desired power and the actual power of the generator has become higher than double the requirements of the generator.

3. The method as claimed in claim 1, wherein the predetermined first time span is between 100 ms and 200 ms.

4. The method as claimed in claim 3, wherein the predetermined first time span is 150 ms.

5. The method as claimed in claim 1, wherein the predetermined second time span is between 4 s and 10 s.

6. The method as claimed in claim 5, wherein the predetermined second time span is 7 s.

7. The method as claimed in claim 1, wherein the generation of the third signal which indicates load shedding takes place as the third function of the first signal and of a predetermined third time span.

8. The method as claimed in claim 7, wherein the predetermined third time span is between 1.5 s and 2.5 s.

9. The method as claimed in claim 8, wherein the predetermined third time span is 2 s.

10. The method as claimed in claim 1, wherein the generation of the third signal which indicates load shedding takes place as the third function of a load switch for the generator.

11. A device for controlling a steam power plant having a generator and a turbine, comprising:

a means for providing a first signal which indicates a drop in the actual power of the generator;

a means for generating a second signal which indicates a short circuit interruption, as a first function of the first signal;

a means for resetting the second signal after a predetermined first time span and for blocking the second signal for a predetermined second time span;

a means for stopping and subsequently starting the turbine as a second function of the second signal;

a means for generating a third signal which indicates load shedding, as a third function of the first signal; and a means for the permanent stopping of the turbine as a fourth function of the third signal.

12. The device as claimed in claim 11, wherein the first signal is provided when the actual power of the generator has dropped abruptly by an amount of a predetermined value, or the first signal is provided when the actual power of the generator has fallen to a predetermined negative value and the actual power of the generator has become lower than double the requirements of the generator and a difference between a desired power and the actual power of the generator has become higher than double the requirements of the generator.

13. The device as claimed in claim 11, wherein the predetermined first time span is between 100 ms and 200 ms.

14. The device as claimed in claim 13, wherein the predetermined first time span is 150 ms.

15. The device as claimed in claim 11, wherein the predetermined second time span is between 4 s and 10 s.

16. The device as claimed in claim 15, wherein the predetermined second time span is 7 s.

17. The device as claimed in claim 11, wherein the generation of the third signal which indicates load shedding takes place as the third function of the first signal and of a predetermined third time span.

18. The device as claimed in claim 17, wherein the predetermined third time span is between 1.5 s and 2.5 s.

19. The device as claimed in claim 18, wherein the predetermined third time span is 2 s.

20. The device as claimed in claim 11, wherein the generation of the third signal which indicates load shedding takes place as the third function of a load switch for the generator.

* * * * *